US008500223B2

(12) United States Patent
Lacarra

(10) Patent No.: US 8,500,223 B2
(45) Date of Patent: Aug. 6, 2013

(54) SLIDE ASSEMBLY WITH DUAL HANDED BALL RETAINER LATCH

(75) Inventor: David Laniado Lacarra, Mexicali (MX)

(73) Assignee: Accuride International, Inc., Santa Fe Springs, CA (US)

( * ) Notice: Subject to any disclaimer, the term of this patent is extended or adjusted under 35 U.S.C. 154(b) by 193 days.

(21) Appl. No.: 13/192,310

(22) Filed: Jul. 27, 2011

(65) Prior Publication Data

US 2012/0027325 A1 Feb. 2, 2012

Related U.S. Application Data

(60) Provisional application No. 61/368,234, filed on Jul. 27, 2010.

(51) Int. Cl.
*A47B 88/00* (2006.01)
*A47B 95/00* (2006.01)

(52) U.S. Cl.
USPC ..... 312/334.45; 312/333

(58) Field of Classification Search
USPC ..... 312/333, 334.44–334.47; 384/18, 384/21
See application file for complete search history.

(56) References Cited

U.S. PATENT DOCUMENTS

| | | | | |
|---|---|---|---|---|
| 5,507,571 | A | 4/1996 | Hoffman | |
| 6,145,945 | A | 11/2000 | Parvin | |
| 6,805,418 | B2 | 10/2004 | Milligan | |
| 7,090,319 | B2 * | 8/2006 | Milligan et al. | 312/334.46 |
| 8,240,789 | B2 * | 8/2012 | Chen et al. | 312/334.7 |
| 2002/0089272 | A1 * | 7/2002 | Liang et al. | 312/333 |
| 2003/0042831 | A1 * | 3/2003 | Le et al. | 312/334.44 |
| 2004/0130249 | A1 * | 7/2004 | Judge et al. | 312/334.46 |
| 2004/0207301 | A1 * | 10/2004 | Chen et al. | 312/333 |
| 2005/0017614 | A1 * | 1/2005 | Cirocco et al. | 312/333 |
| 2006/0163983 | A1 * | 7/2006 | Wu | 312/333 |
| 2006/0244349 | A1 * | 11/2006 | Chen et al. | 312/334.47 |
| 2006/0279187 | A1 * | 12/2006 | Yang et al. | 312/333 |
| 2008/0197758 | A1 | 8/2008 | Mushan et al. | |
| 2008/0211366 | A1 | 9/2008 | Brock et al. | |
| 2009/0224643 | A1 | 9/2009 | Kouchi | |
| 2010/0259146 | A1 * | 10/2010 | Chen et al. | 312/319.1 |
| 2012/0153792 | A1 * | 6/2012 | Yu et al. | 312/333 |

FOREIGN PATENT DOCUMENTS

KR 10-2008-0055647 6/2008

OTHER PUBLICATIONS

International Search Report on related PCT application (PCT/US2011/045596) from International Searching Authority (KIPO) dated Feb. 9, 2012.

Written Opinion on related PCT application (PCT/U52011/045596) from International Searching Authority (KIPO) dated Feb. 9, 2012.

* cited by examiner

*Primary Examiner* — David Dunn
*Assistant Examiner* — Ryan A Doyle
(74) *Attorney, Agent, or Firm* — Klein, O'Neill & Singh, LLP

(57) ABSTRACT

A slide assembly has a gravity biased latch arm on a slide member with a head having opposing barbs each insertable into a respective one of opposing cutouts in a bearing retainer of the slide assembly to provide a bearing retainer function. The latch arm and the cutouts in the bearing retainer are positioned such that the latch head may enter a cutout when an inner slide member is removed from the slide member. The use of dual barbs and opposing cutouts allows for unhanded operation of the bearing retainer function.

24 Claims, 12 Drawing Sheets

SLIDE ASSEMBLY WITH DUAL HANDED BALL RETAINER LATCH

CROSS REFERENCE TO RELATED APPLICATIONS

This application claims the benefit of the filing date of U.S. Provisional Patent Application No. 61/368,234, filed Jul. 27, 2010, the disclosure of which is incorporated by reference.

BACKGROUND OF THE INVENTION

This invention relates generally to slides, and more particularly to bearing retainer retention devices for slides.

Telescopic slides for file drawers and the like are often desirable for use in cabinets and rack mounted applications. Such slides permit easy access to the interior of the drawer, or to equipment mounted in a rack. The slides support the equipment, while allowing slidable or rollable insertion and extraction of the equipment from the rack. A typical drawer slide has two or three slide members slidably, e.g., rollably, connected by sets of bearings riding in raceways formed on the slide members. Individual bearings within a set of bearings are often held in relative position to one another by bearing retainers.

One type of slide is a telescopic drawer slide. In a telescopic slide the various slide members comprising the slide are nested within one another and extend from one another in a telescopic manner. Two-element telescopic slides normally include an outer slide member and an inner slide member. The outer slide member is generally either connected to the rack or enclosure, or coupled to the rack by way of intermediate elements such as brackets or other hardware, although it is recognized that the inner slide member may instead be so connected or coupled. The inner member is generally connected or coupled by hardware to equipment, such as computer equipment, to be stored in the rack. A three-element telescopic slide will additionally normally include an intermediate slide member slidably coupled to and between the outer and inner slide members.

Each slide member, whether an outer slide member, inner slide member, or intermediate slide member, generally comprises a vertical web with bearing raceways extending horizontally from upper and lower margins of the vertical web. The bearings coupling a pair of slide members are often held by a common bearing retainer. The bearing retainers generally mirror in shape the drawer slide members, although the bearing retainers may include a hat like portion in the vertical web. Accordingly, the common bearing retainer also has a vertical web, and flanges extending from the upper and lower margins of the vertical web for retaining bearings, and possibly a hat like portion in the vertical web.

Often a mechanism is provided so that the inner slide member can be disconnected from the outer slide member, for example so that equipment held by the slide may be entirely removed from the rack for service or replacement, and then reinserted within the outer slide member. The process of reinserting the inner slide member within the outer slide member (or intermediate slide member for a three member slide) is more easily accomplished if the bearing retainer is maintained in a position near the forward end of the outer slide member. In addition, if the bearing retainer is not maintained in such a position then misalignment of the inner slide member with respect to the outer slide member during the reinsertion process may result in inadvertent contact between the inner slide member and the bearing retainer. As the inner slide member tends to be of a significantly greater thickness than the bearing retainer, this contact may well result in damage to the bearing retainer.

BRIEF SUMMARY OF THE INVENTION

Aspects of the invention provide a slide assembly with a bearing retainer lockout or retention feature.

In some aspects of the invention the bearing retainer lockout feature comprises a latch arm coupled to a first slide member and insertable into a cutout of the bearing retainer. In some embodiments the first slide member is an intermediate slide member and the bearing retainer retains bearings coupling the intermediate slide member and an inner slide member. In some embodiments the latch arm extends through a cutout of the first slide member. In some embodiments the latch arm is normally biased by gravity. In some embodiments the bearing retainer includes opposing cutouts and the latch arm may be biased by gravity into either cutout, depending on orientation of the slide assembly in space.

In one aspect, the invention provides a drawer slide assembly with ball retainer, comprising: a first slide member with a web longitudinally bordered by arcuate raceways, the web including a cutout; a second slide member extendably nested within the first slide member; a bearing retainer disposed between the first slide member and the second slide member, the bearing retainer retaining bearings coupling the first slide member and the second slide member, the bearing retainer being at partially between an interior side of the web of the first slide member and the second slide member, the bearing retainer including at least one cutout; and a latch arm pivotably coupled to an exterior side of the web of the first slide member, the latch arm including a head extending at least partially through the cutout of the web of the first slide member to the interior side of the web of the first slide member, the head at least partially insertable into the at least one cutout of the bearing retainer when the cutout of the bearing retainer is positioned about the cutout of the web of the first slide member.

In another aspect, the invention provides a slide assembly, comprising: a first slide member having a longitudinal web bounded by bearing raceways; a second slide member longitudinally extendable and removable relative to the first slide member, the second slide member having a longitudinal web bounded by bearing raceways; a bearing retainer for holding bearings positioned to couple the bearing raceways of the first slide member and the bearing raceways of the second slide member, the bearing retainer including cutouts symmetrically disposed about a longitudinal axis of the bearing retainer; and a latch arm pivotably coupled to the web of the first slide member, the latch arm pivotable into cutouts of the bearing retainer.

These and other aspects of the invention are more fully comprehended on review of this disclosure.

DETAILED DESCRIPTION

Figure 1:
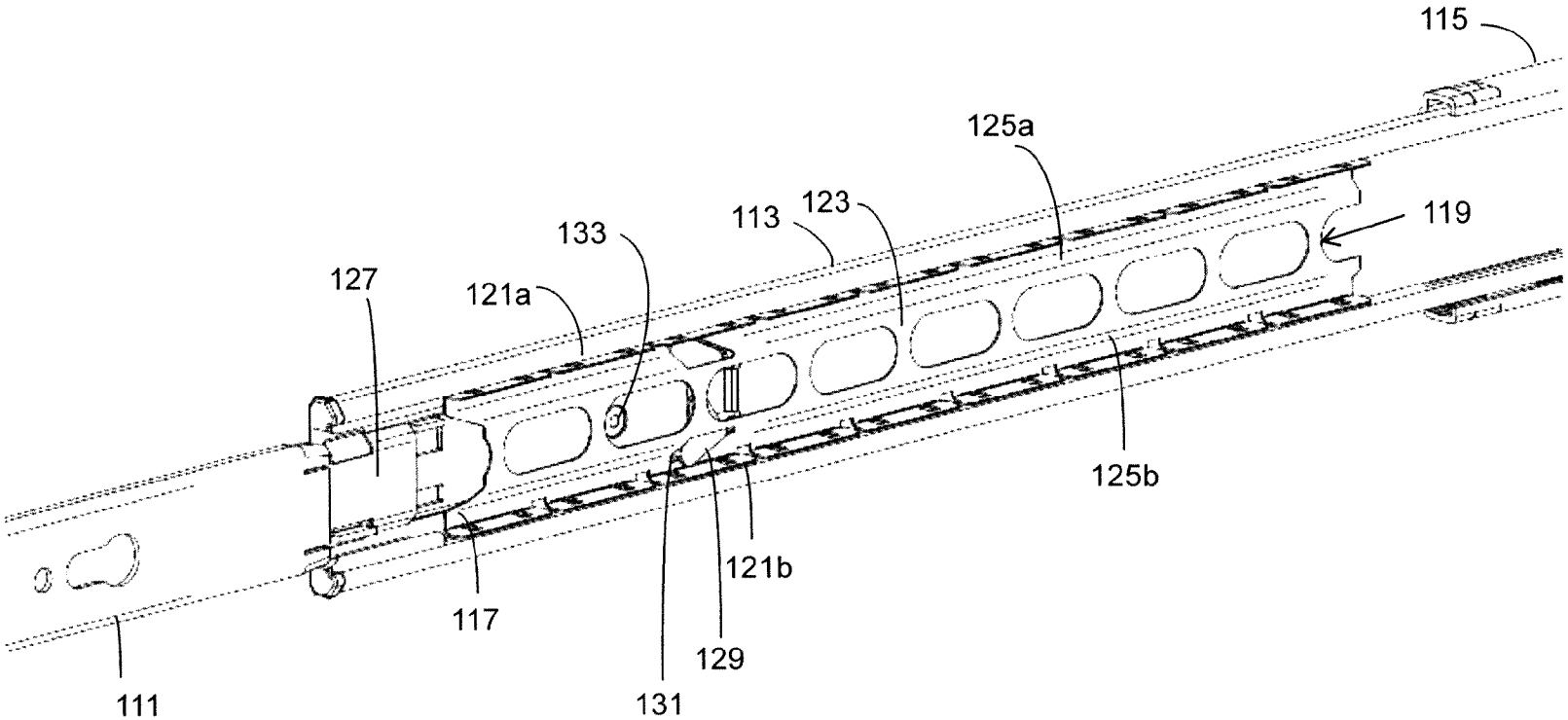
FIG. 1 is a perspective view of portions of a slide assembly in accordance with aspects of the invention.

FIG. 1 shows a perspective view of portions of what may be considered a front of a slide assembly in accordance with aspects of the invention. The slide assembly includes a telescopic slide, with an inner slide member 111 extendably nested within an intermediate slide member 113, which in turn is extendably nested within an outer slide member 115. As is common with telescopic slides, each of the slide members are roughly C-shaped with a web longitudinally bordered by arcuate raceways. Although not explicitly shown in FIG. 1, bearings slidably or rollably couple the slide members. In various embodiments, and for various slide members, the raceways may be U-shaped, may be formed with bended over portions of the slide member, or may be otherwise formed.

A bearing retainer 117 is disposed between the inner slide member and the intermediate slide member during operation. The bearing retainer includes a web 119 with opposing flanges 121*a,b* with holes for receiving bearings along longitudinal margins of the web. The web of the bearing retainer also includes a protruding longitudinal middle section 123 coupled to a base of the web by angled sections 125*a,b*, which provides the web a somewhat hat shaped cross-section when the bearing retainer is viewed in a horizontal position with the opposing flanges facing upwards. The protruding middle section is useful in that it provides clearance for hardware or other items that may extend or protrude from the web of the intermediate slide member.

As illustrated in FIG. 1, the inner slide member has been completely withdrawn from the intermediate slide member, a capability that is useful in many instances. A variety of latching mechanisms to allow complete withdrawal of the inner slide member from the intermediate slide member when desired, while otherwise stopping extension of the inner slide prior to such withdrawal, are known.

In some embodiments the bearing retainer is prevented from being withdrawn from the intermediate slide member by a guide block 127, which also assists in guiding motion of the inner slide member during extension of the inner slide member from the intermediate slide member. In addition, retraction (and in some embodiments further extension) of the bearing retainer into the intermediate slide member is prevented by a barb 129 of a head of a latch arm positioned in a cutout 131 of the bearing retainer. The latch arm is coupled by a pin 133 in the web of the intermediate slide member. In the embodiment of FIG. 1, the cutout is in the web of the bearing retainer, with the cutout beginning in the protruding middle portion and extending through the angled section and terminating in the base of the web.

As may be partially seen in FIG. 1, the bearing retainer includes opposing cutouts at the same longitudinal position on the bearing retainer and the latch head includes dual opposing barbs. The dual cutouts and the dual barbs allow the latch head to restrict movement of the bearing retainer through contact between either of the barbs and walls of either of the cutouts.

Figure 2:
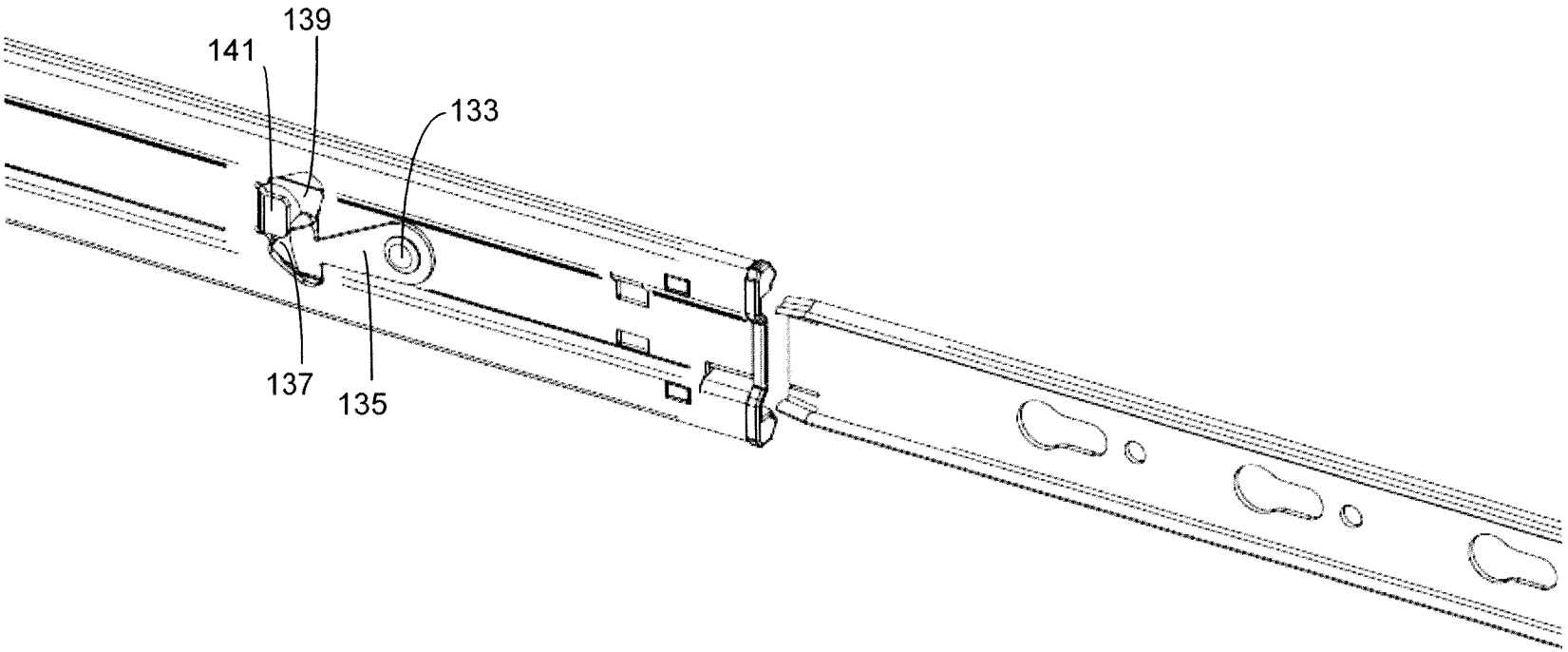
FIG. 2 is a further perspective view of portions of the slide assembly of FIG. 1.

FIG. 2 is a perspective view of what may be considered a rear of the slide assembly of FIG. 1. The inner slide member is shown extracted from the intermediate slide member, with the outer slide member not visible in FIG. 2. In some embodiments, however, the slide may be a two member slide, with what is shown as the intermediate slide member being an outer slide member. In addition, in some embodiments what is shown as the intermediate slide member may have other shapes, for example the intermediate slide member may be an intermediate slide member of an over and under slide, with for example the intermediate slide member having an S-shaped cross-section.

In FIG. 2, the latch arm is pivotably coupled to an exterior of the web of the intermediate member by the pin 133. The latch arm includes an extending member 135 terminating in the head. The pin passes through the extending member of the latch arm, about an end opposite the head 137. The pin may be a rivet or screw or the like, passing through an aperture in the web of the intermediate member. The latch arm extends generally towards a rear and along the web of the intermediate slide member. The head of the latch arm is generally offset from the extending member, with the offset sufficient that the head may pass through a cutout 139 in the web of the intermediate slide member to the interior of the intermediate slide member. In the embodiment of FIG. 2, the offset is provided by providing a portion of the head with increased thickness, with the increased thickness being about a base of the head, which additionally provides the head increased strength. Also in the embodiment illustrated in FIG. 2, the intermediate slide member also includes a tab 141 offset exteriorly to generally maintain the head of the latch arm towards the interior of the intermediate slide member.

Figure 3:
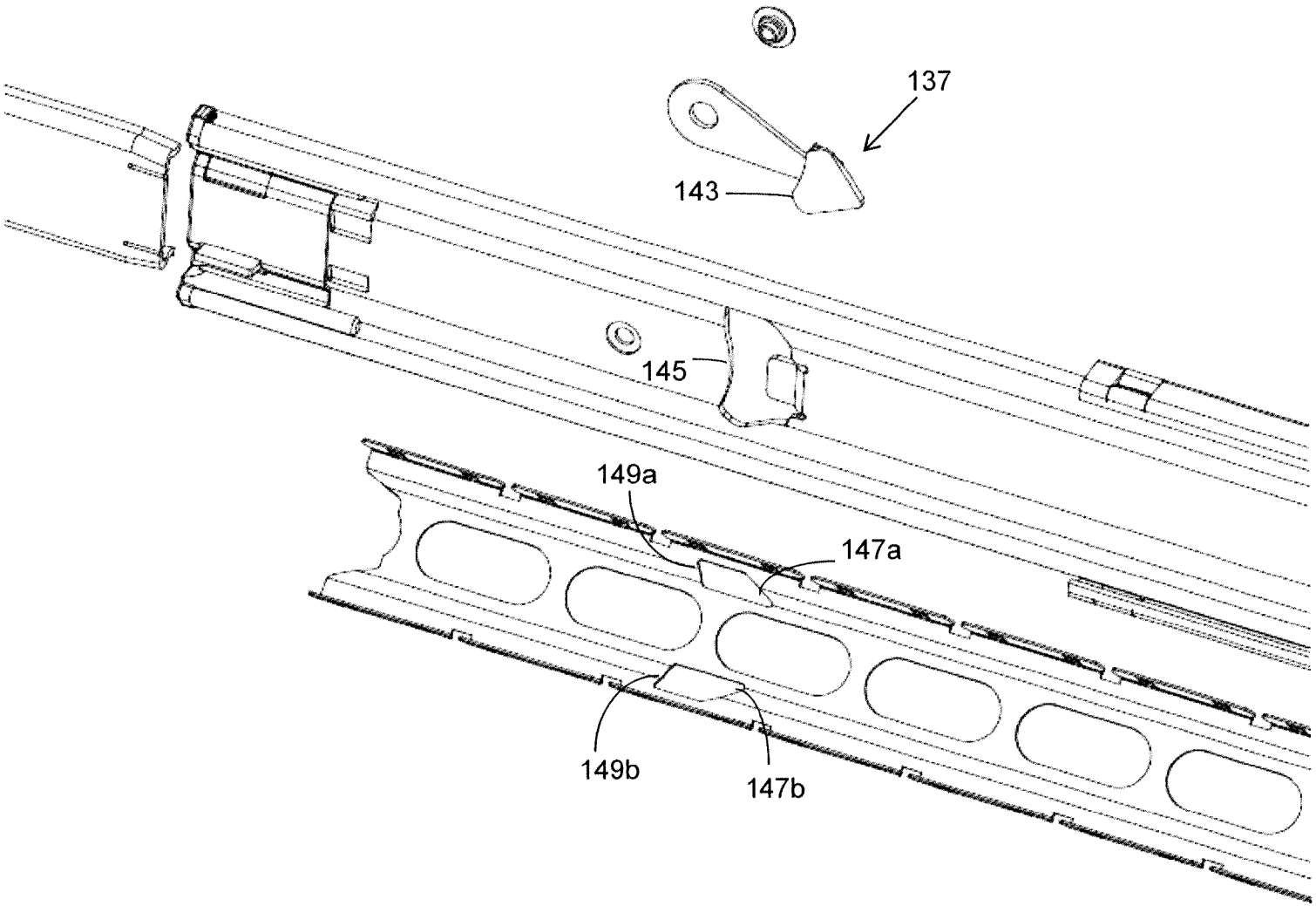
FIG. 3 is a partially exploded view of the slide assembly of FIG. 1.

FIG. 3 provides a partially exploded view of the slide assembly of FIG. 1. The head 137 of the latch arm, as may be more easily seen in FIG. 3, is generally symmetrical about a central axis of the latch arm, and includes a concave base 143 forming barbs on either side of the central axis. Also as may be seen in FIG. 3, the cutout in the intermediate slide member extends through a mid-portion of the web of the intermediate slide member. The web of the particular intermediate slider member illustrated includes a protruding longitudinal middle portion, and the cutout crosses this portion. In addition, the cutout includes a curved forward portion 145 to provide increased clearance for the head of the latch arm, considering the pivoting movement of the latch arm.

The cutouts in the bearing retainer each include a rearwardly inward rear wall 147*a,b* and a forward wall 149*a,b* which also has a slight rearwardly inward angle. In various other embodiments the cutout may have other shapes, however. The rear wall prevents further forward movement of the bearing retainer in some embodiments. The slight rearwardly inward angle for the forward walls provides a somewhat downward biasing force against the head of the latch arm if the bearing retainer is forced towards the rear of the slide assembly when the head of the latch arm is in the cutout of the bearing retainer. This is particularly so if the head of the latch arm includes a concave or similarly shaped base such that attempts to force the bearing retainer rearward also serve to force the head of the latch arm downward, maintaining the head of the latch arm in the cutout of the bearing retainer.

Both the cutout in the intermediate slide member and the cutouts in the bearing retainer are positioned such that the cutout of the bearing retainer is about the cutout of the intermediate member when a forward edge of the bearing retainer abuts, or is close to abutting, a guide block at the forward end of the intermediate slide member. Withdrawal of the inner slide member from the intermediate slide member will normally bring the retainer to such a position, allowing the head of the latch arm to enter the cutout of the bearing retainer.

Figure 4A:
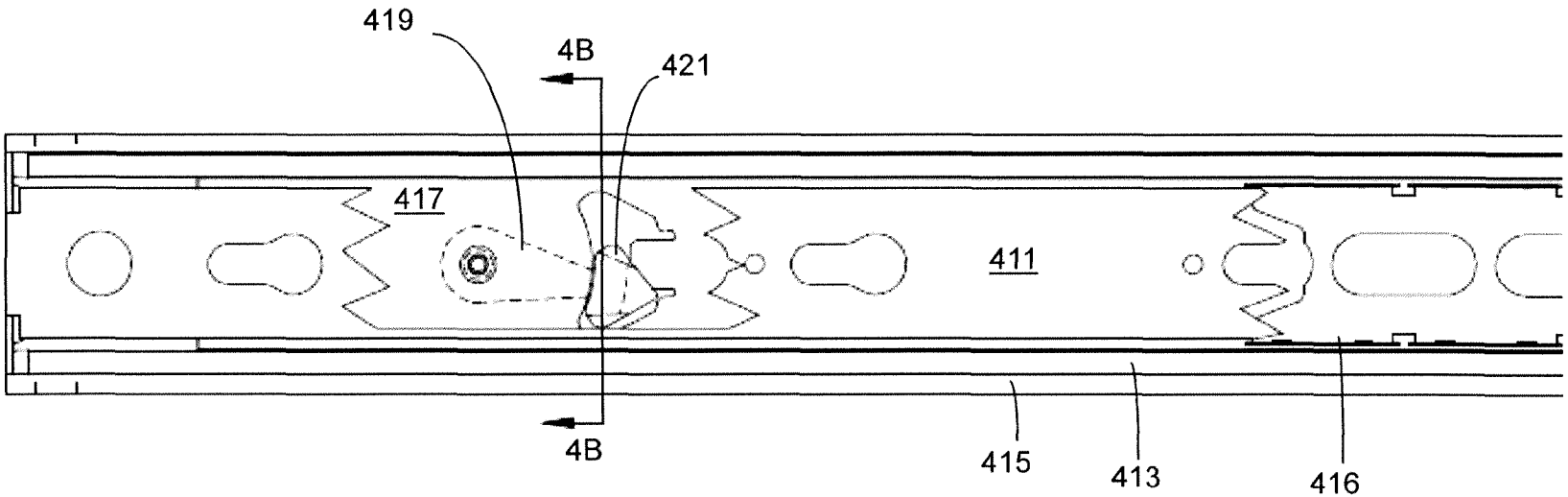
FIG. 4A illustrates a view of a slide assembly in accordance with aspects of the invention.
Figure 4B:
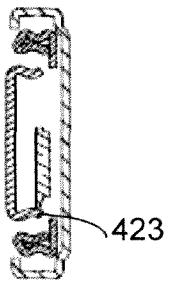
FIG. 4B is a cross-sectional view of the slide assembly of FIG. 4A.

FIG. 4A shows a partial view of a slide assembly in accordance with aspects of the invention, with the slide assembly in the closed or retracted position. The slide assembly of FIG. 4A includes a three member telescopic slide with an inner slide member 411 nested within an intermediate slide member 413, which in turn is nested within an outer slide member 415. A bearing retainer 416 retains bearings slidably or rollably coupling the inner slide member and the intermediate slide member. The inner slide member is shown in partial cut away view, such that portions of a web 417 of the intermediate slide member may be seen. As illustrated in FIG. 4, a latch arm 419 is pivotably coupled to the intermediate slide member. A head 421 of the latch arm extends to the interior of the intermediate slide member and rests on an edge of a raceway 423 of the inner slide member, as may also be seen in the cross-sectional view of FIG. 4B. The head of the latch arm is normally biased downward to the raceway by gravity, although in some embodiments springs or other biasing elements may be used. In the embodiment of FIG. 4, as with the embodiment illustrated in FIGS. 1-3, the cutout in the intermediate slide member is shaped so as to allow the head of the latch arm to move towards either longitudinal side of the intermediate slide member. Also, as previously indicated for FIGS. 1-3, and also later discussed, opposing cutouts in the bearing retainer allow the head of the latch arm to be positioned in either of the opposing cutouts. Such symmetry is useful in that installation of a slide assembly on one side of a rack results in one longitudinal side of the slide assembly facing downwards, and installation of the slide assembly on an opposing side of a rack results in the other longitudinal side of the slide assembly facing downwards. By allowing for movement of the head of the latch arm towards either longitudinal side, and by having cutouts in opposing longitudinal sides of the bearing retainer, the bearing retainer position retention provided by positioning of the latch head in a cutout of the bearing retainer is operable in either position on the rack. As the opposing sides of a rack may be considered a right hand side or a left hand side, the slide assembly may be considered to have a dual handed bearing retainer latch. In addition, as the head of the latch arm is biased by gravity, at least in some embodiments, the slide assembly may be considered to have a dual handed gravity biased bearing retainer latch.

Figure 5A:
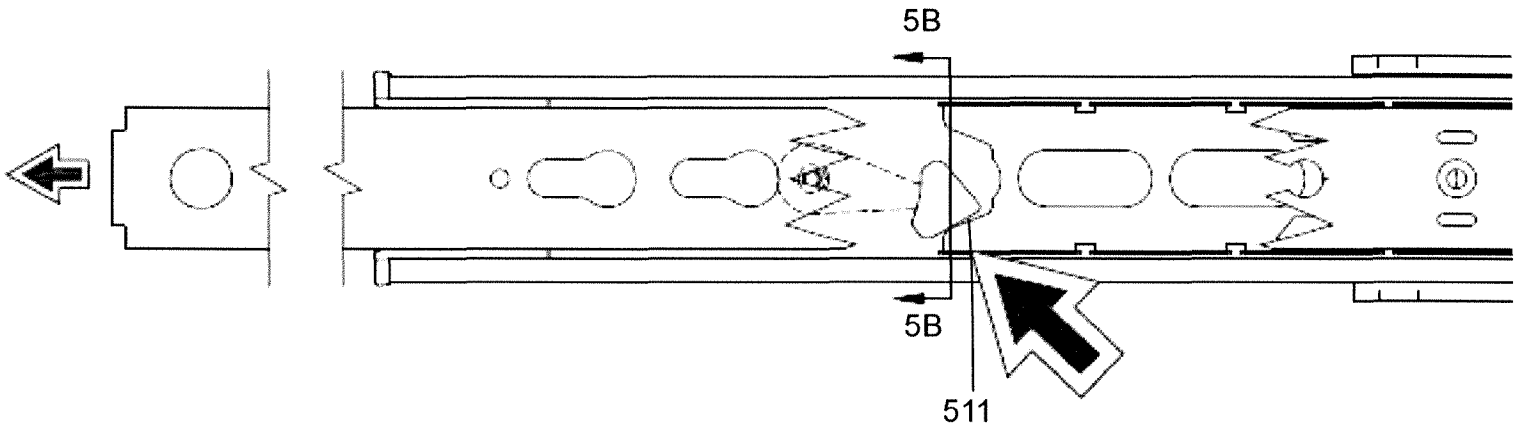
FIG. 5A illustrates a view of the slide assembly of FIG. 4A during further operation.
Figure 5B:
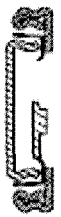
FIG. 5B is a cross-sectional view of the slide assembly of FIG. 5A.
Figure 6A:
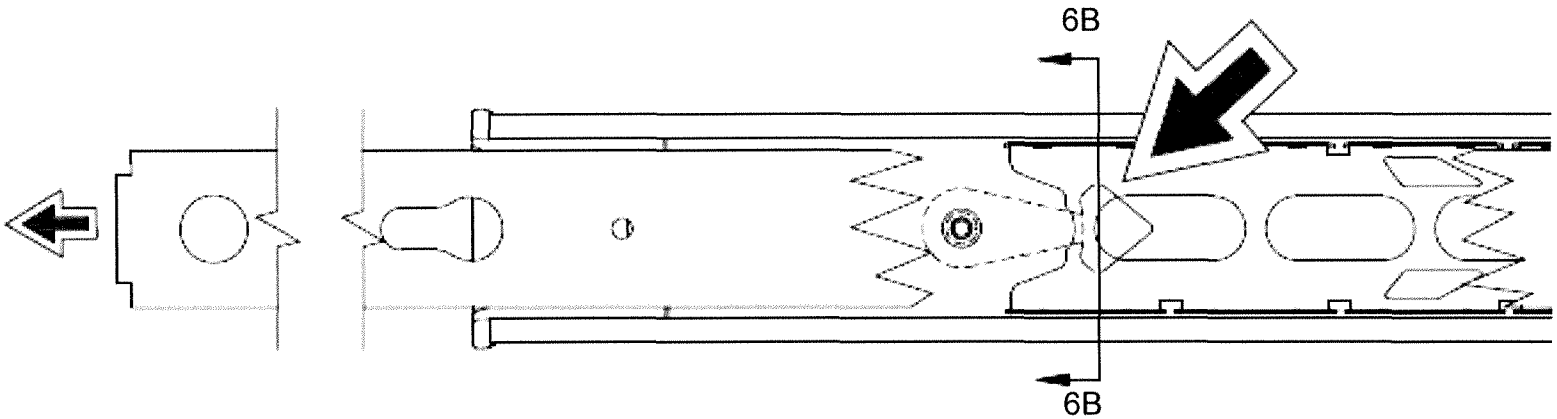
FIG. 6A illustrates a view of the slide assembly of FIG. 4A during further operation.
Figure 6B:
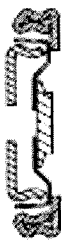
FIG. 6B is a cross-sectional view of the slide assembly of FIG. 6A.

Turning to FIG. 5A, as the inner slide member 411 is extended from the intermediate slide member 413, such as may occur while opening a drawer or pulling equipment out of a rack, an angled portion of the arrowhead shaped head of the latch arm contacts and is picked up by a ramp cutout 511 in a front of the ball retainer, as may also be seen in the cross-sectional view of FIG. 5A. As may be seen in FIG. 6A, the head of the latch arm thereafter rides in the hat section of the bearing retainer as the inner slide member is further extended from the intermediate slide member, as is also shown in the cross-sectional view of FIG. 6B.

Figure 7A:
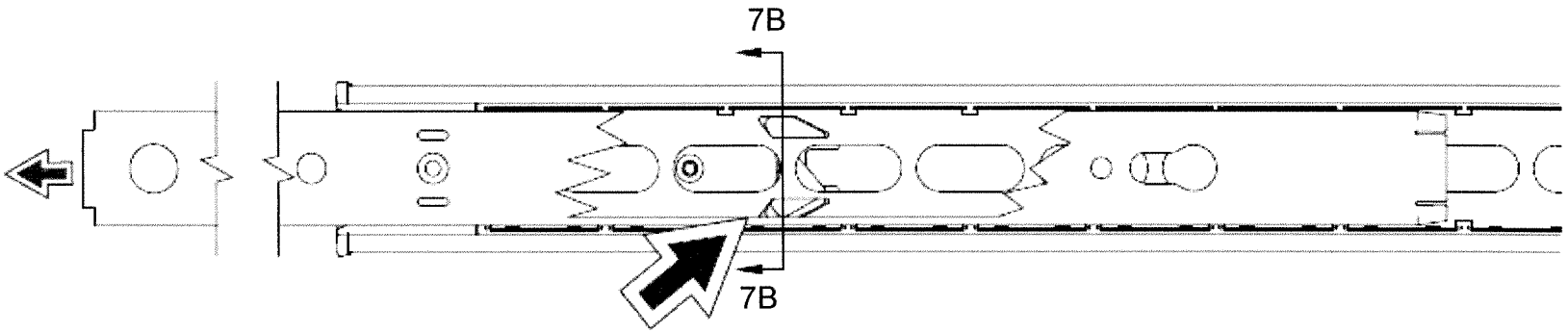
FIG. 7A illustrates a view of the slide assembly of FIG. 4A during further operation.
Figure 7B:
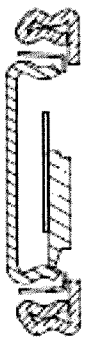
FIG. 7B is a cross-sectional view of the slide assembly of FIG. 7A.

Turning to FIG. 7A, as the inner slide member is extended from the intermediate slide member, the head of the latch arm reaches the cutout of the bearing retainer, which generally travels along with the inner slide, albeit at a possible reduced rate of motion. Once the head of the latch arm reaches the cutout of the bearing retainer, the head of the latch arm falls, due to gravity, through the cutout of the bearing retainer and back onto the surface of the bearing raceway of the inner member, as may also be seen in the cross-sectional view of FIG. 7B.

Figure 8A:
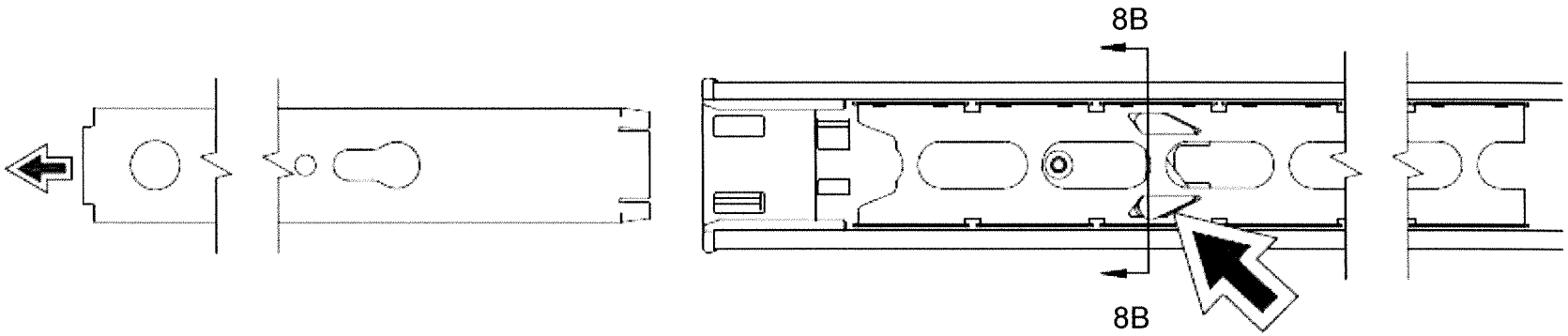
FIG. 8A illustrates a view of the slide assembly of FIG. 4A during, further operation.
Figure 8B:
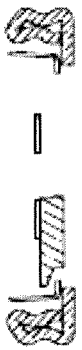
FIG. 8B is a cross-sectional view of the slide assembly of FIG. 8A.

FIG. 8A and the cross sectional view of FIG. 8B show the inner slide member extended sufficiently from the intermediate slide member so as to disconnect the inner slide member from the intermediate slide member. Doing so causes the bearing retainer to move forward sufficiently that the head of the latch arm may fall, due to gravity, into the cutout of the bearing retainer. With the head of the latch arm in the cutout, rearward motion of the bearing retainer is prevented through contact of the forward wall of the cutout and the base of the head of the latch arm. In some embodiments forward motion of the bearing retainer is restricted by a leading edge of the head of the latch arm and a rearward wall of the cutout of the bearing retainer. The bearing retainer may also be restricted from moving forward, at least to a position in which the bearing retainer extends forward of the intermediate slide member, by a guide block of the intermediate slide member.

Figure 9A:
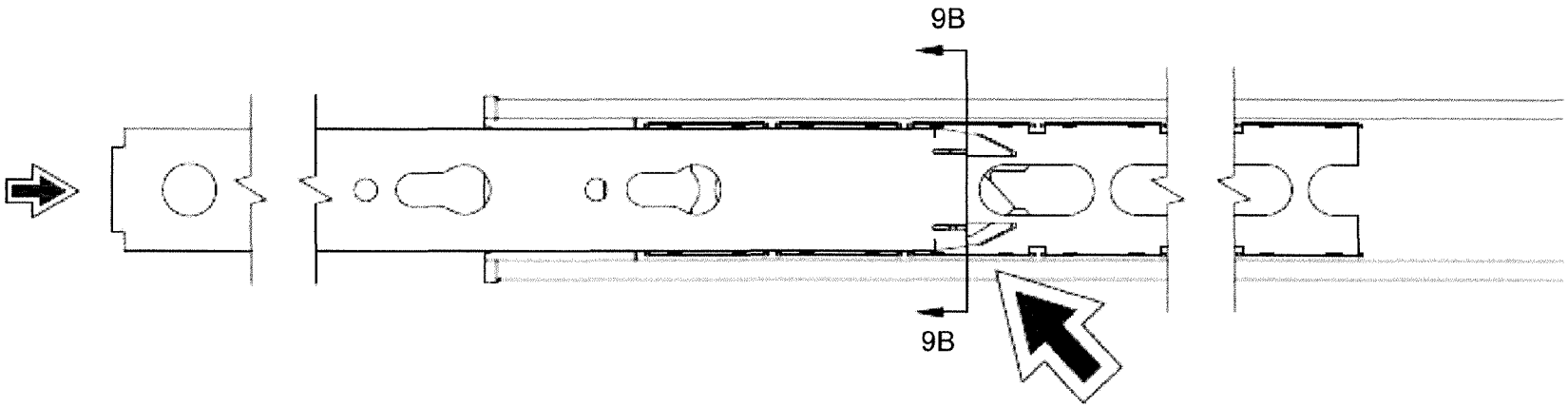
FIG. 9A illustrates a view of the slide assembly of FIG. 4A during further operation.
Figure 9B:
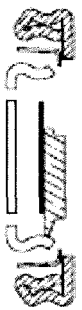
FIG. 9B is a cross-sectional view of the slide assembly of FIG. 9A.
Figure 10A:
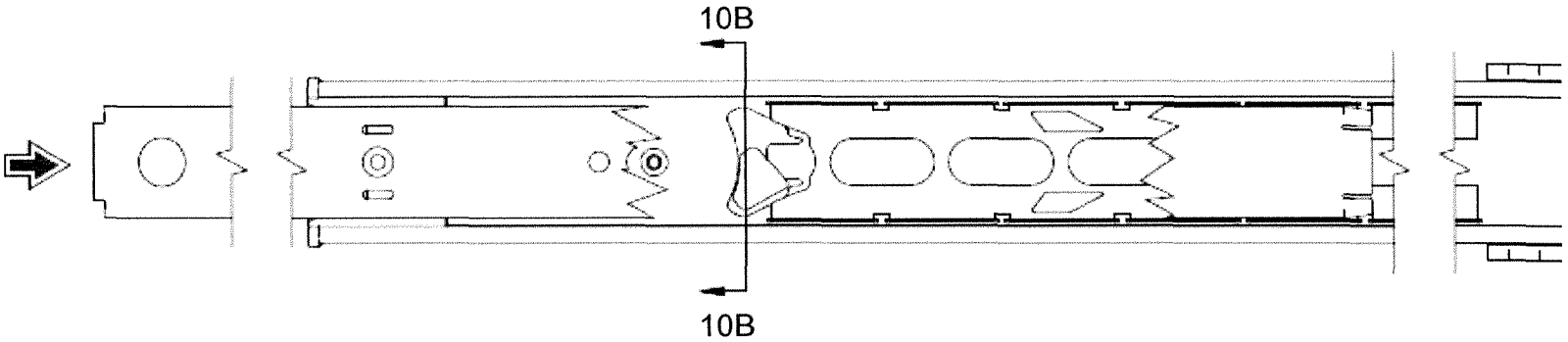
FIG. 10A illustrates a view of the slide assembly of FIG. 4A during further operation.
Figure 10B:
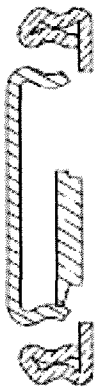
FIG. 10B is a cross-sectional view of the slide assembly of FIG. 10A.

Reinsertion of the inner slide member into the intermediate slide member results in a rear edge of the inner slide member lifting the head of the latch arm out of the cutout of the bearing retainer and onto the bearing raceway of the inner slide member, as may be seen in FIG. 9A and the cross-sectional view of FIG. 9B. The bearing retainer may therefore travel towards the rear of the intermediate slide member, along with the inner slide member, or forward once again if the inner slide member is thereafter again moved forward, as may be seen in FIG. 10A and the cross-sectional view of FIG. 10B.

Figure 11:
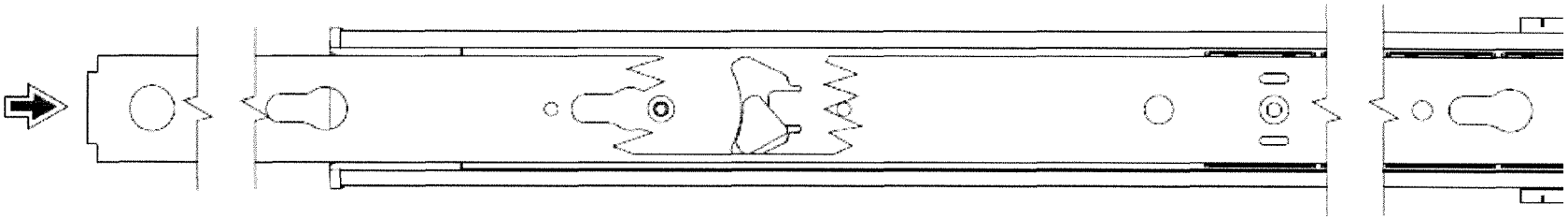
FIG. 11 illustrates a view of the slide assembly of FIG. 4A during further operation.
Figure 12:
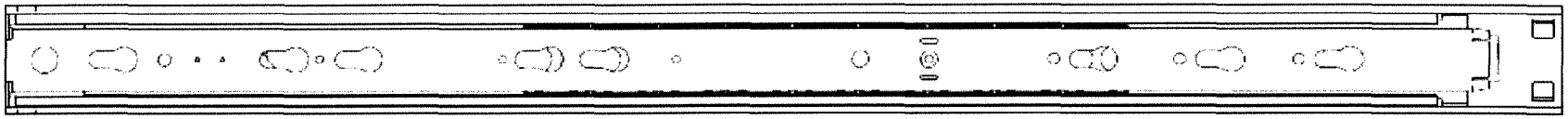
FIG. 12 illustrates a view of the slide assembly of FIG. 4A during further operation.

In some embodiments it is desirable to ensure that the bearing retainer is properly positioned, or sequenced, with respect to the inner slide member and the intermediate slide member. In such embodiments, fully closing the slide assembly, for example by closing a drawer coupled to the slide assembly or fully retracting the slide assembly within a rack may be performed, relying on guideblocks or other items or means to properly sequence the bearing retainer. FIG. 11 illustrates closing of the slide assembly, with a closed slide assembly being for example shown in FIG. 12.

Although aspects of the invention have been discussed with respect to various embodiments, it should be recognized that the invention comprises the novel and non-obvious claims and their insubstantial variations supported by this disclosure.

What is claimed is:

1. A drawer slide assembly with ball retainer, comprising:

a first slide member with a web longitudinally bordered by arcuate raceways, the web including a cutout;

a second slide member extendably nested within the first slide member;

a bearing retainer disposed between the first slide member and the second slide member, the bearing retainer retaining bearings coupling the first slide member and the second slide member, the bearing retainer being at partially between an interior side of the web of the first slide member and the second slide member, the bearing retainer including at least one cutout; and a latch arm pivotably coupled to an exterior side of the web of the first slide member, the latch arm including a head extending at least partially through the cutout of the web of the first slide member to the interior side of the web of the first slide member, the head at least partially insertable into the at least one cutout of the bearing retainer when the cutout of the bearing retainer is positioned about the cutout of the web of the first slide member.

2. The drawer slide assembly with ball retainer of claim 1, wherein the at least one cutout of the bearing retainer comprises dual opposing cutouts.

3. The drawer slide assembly with ball retainer of claim 2, wherein the head is gravity biased towards a lower one of the dual opposing cutouts.

4. The drawer slide assembly with ball retainer of claim 2, wherein the head of the latch arm includes barbs on either side of a central axis defined by the latch arm.

5. The drawer slide assembly with ball retainer of claim 4, wherein the barbs of the head of the latch arm are at least partially insertable into the dual opposing cutouts.

6. The drawer slide assembly with ball retainer of claim 2, wherein the dual opposing cutouts of the bearing retainer include a forward wall with a rearwardly inward angle.

7. The drawer slide assembly with ball retainer of claim 1, further comprising a guide block at a forward end of the first slide member, and wherein the cutout of the bearing retainer is positioned about the cutout of the web of the first slide member when the bearing retainer is positioned to abut the guide block.

8. The drawer slide assembly with ball retainer of claim 7, wherein the bearing retainer is positioned to abut the guide block when the second slide member is disconnected from the first slide member.

9. A slide assembly, comprising:

a first slide member having a longitudinal web bounded by bearing raceways;

a second slide member longitudinally extendable and removable relative to the first slide member, the second slide member having a longitudinal web bounded by bearing raceways;

a bearing retainer for holding bearings positioned to couple the bearing raceways of the first slide member and the bearing raceways of the second slide member, the bearing retainer including cutouts symmetrically disposed about a longitudinal axis of the bearing retainer; and a latch arm pivotably coupled to the web of the first slide member, the latch arm pivotable into cutouts of the bearing retainer.

10. The slide assembly of claim 9, wherein the latch arm is pivotably coupled to the web of the first slide member approximate a forward end of the first slide member.

11. The slide assembly of claim 10, wherein the bearing retainer is between the first slide member and the second slide member, the latch arm includes a first portion on a side of a plane defined by the web of the first slide member facing away from the second slide member, and the latch arm includes a second portion on a side of the plane defined by the web of the first slide member facing towards the second slide member.

12. The slide assembly of claim 11, wherein the second portion of the latch arm includes a head with barbs on opposing edges.

13. The slide assembly of claim 12, wherein the barbs are shaped such that contact with the second slide member upon reinsertion of the second slide member into the slide assembly results in lifting the head of the latch arm out of one of the cutouts of the bearing retainer.

14. The slide assembly of claim 2 wherein the cutouts of the bearing retainer and the latch arm are positioned such that one of the barbs contacts a first wall of one of the cutouts to block movement of the bearing retainer relative to the first slide member in a forward direction when the latch arm is pivoted into the one of the cutouts.

15. The slide assembly of claim 14, wherein the first wall of each of the cutouts of the bearing retainer angles toward a forward end of the bearing retainer with distance from the longitudinal axis of the bearing retainer.

16. The slide assembly of claim 15, wherein each of the cutouts of the bearing retainer includes a second wall, opposite the first wall, that angles toward a rear of the bearing retainer with distance from the longitudinal axis of the bearing retainer.

17. The slide assembly of claim 14, wherein a base portion of the head of the latch arm forming the barbs is concave.

18. The slide assembly of claim 11, wherein the latch arm extends through a cutout of the web of the first slide member.

19. The slide assembly of claim 18, wherein the longitudinal web of the first slide member further includes a tab offset from the cutout of the web of the first slide member and positioned to block movement of the latch arm away from the longitudinal web in at least one direction.

20. The slide assembly of claim 9, wherein the latch arm is biased by gravity to pivot into the one of the cutouts of the bearing retainer by gravity.

21. The slide assembly of claim 9, wherein the latch arm is symmetrical about a central axis of the latch arm.

22. The slide assembly of claim 9, wherein the bearing retainer further includes a longitudinal web including a protruding middle portion and angled sections connecting the protruding middle portion to the longitudinal margins.

23. The slide assembly of claim 22, wherein each of the cutouts of the bearing retainer begins in the protruding middle portion and extends through one of the angled sections.

24. The slide assembly of claim 9, wherein the latch arm includes a head offset from the pivotable coupling and the longitudinal web of the first member includes a cutout through which the head of the latch arm extends.

* * * * *